US009571944B2

(12) United States Patent
Fischer et al.

(10) Patent No.: US 9,571,944 B2
(45) Date of Patent: Feb. 14, 2017

(54) HEARING AID AND METHOD FOR PRODUCING A HEARING AID

(71) Applicant: SIVANTOS PTE. LTD., Singapore (SG)

(72) Inventors: Thomas Fischer, Erlangen (DE); Hans Adel, Stein (DE); Johannes Kuhn, Nuremberg (DE); Jan Bauer, Fuerth (DE); Mario Schuehler, Marloffstein (DE); Frank Naumann, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/737,778

(22) Filed: Jun. 12, 2015

(65) Prior Publication Data

US 2015/0281859 A1 Oct. 1, 2015

Related U.S. Application Data

(63) Continuation of application No. PCT/EP2013/063025, filed on Jun. 21, 2013.

(30) Foreign Application Priority Data

Dec. 12, 2012 (DE) ..... 10 2012 222 894

(51) Int. Cl.
*H04R 25/00* (2006.01)
*H01Q 1/27* (2006.01)
(Continued)

(52) U.S. Cl.
CPC ..... *H04R 25/554* (2013.01); *H01Q 1/273* (2013.01); *H01Q 1/38* (2013.01); *H01Q 1/52* (2013.01);
(Continued)

(58) Field of Classification Search
CPC . H04R 2225/33; H04R 25/556; H04R 25/554; H04R 25/65; H04B 5/0031; H01Q 1/245; H01Q 1/243; H04W 88/02; B22F 2003/242
(Continued)

(56) References Cited

U.S. PATENT DOCUMENTS 6,546,109 B1 4/2003 Gnecco et al.
7,450,078 B2 11/2008 Knudsen et al.
(Continued)

FOREIGN PATENT DOCUMENTS

EP 1465457 A2 10/2004
EP 1587343 A2 10/2005
(Continued)

OTHER PUBLICATIONS

McCrary, R.L., et al., "SelectConnect (TM) process for metallizing circuits on molded parts and components" Metal Finishing, Mar. 2010, pp. 35-37, vol. 108, No. 3.

*Primary Examiner* — Quoc D Tran
*Assistant Examiner* — Julie X Dang
(74) *Attorney, Agent, or Firm* — Laurence A. Greenberg; Werner H. Stemer; Ralph E. Locher

(57) ABSTRACT

A hearing aid includes a hearing aid housing and an antenna device constructed to receive and/or transmit electromagnetic waves having a predetermined wavelength lambda. The antenna device has a frame incorporated in the hearing aid housing for holding assemblies of the hearing aid and the frame has an electrically conductive structure being an integral part of the frame. A method for producing a hearing aid includes patterning a surface of the frame, applying an electrically conductive layer to the surface of the frame and incorporating the frame into the hearing aid housing.

12 Claims, 7 Drawing Sheets

(51) Int. Cl.
*H01Q 1/38* (2006.01)
*H01Q 1/52* (2006.01)

(52) U.S. Cl.
CPC ..... *H04R 25/608* (2013.01); *Y10T 29/49018* (2015.01)

(58) Field of Classification Search
USPC ..... 381/315, 318, 312, 313, 322, 323, 23.1, 381/41.2, 314; 455/161.1, 41.1, 90.3, 455/575.7, 82, 274; 343/702, 700 MS
See application file for complete search history.

(56) References Cited

U.S. PATENT DOCUMENTS

| | | | | |
|---|---|---|---|---|
| 7,593,538 | B2 | 9/2009 | Polinske | |
| 7,646,356 | B2 | 1/2010 | Adel et al. | |
| 8,150,071 | B2 | 4/2012 | Kobayashi | |
| 2004/0196996 | A1 | 10/2004 | Feitel | |
| 2005/0099341 | A1* | 5/2005 | Zhang | H01Q 1/273 343/700 MS |
| 2005/0244024 | A1 | 11/2005 | Fischer et al. | |
| 2010/0158293 | A1* | 6/2010 | Polinske | H01Q 1/243 381/315 |
| 2010/0158295 | A1* | 6/2010 | Polinske | H01Q 1/243 381/323 |
| 2011/0312393 | A1* | 12/2011 | Pulimi | H01Q 1/245 455/575.7 |

FOREIGN PATENT DOCUMENTS

| | | | |
|---|---|---|---|
| EP | 1851823 | B1 | 11/2008 |
| EP | 2063694 | A1 | 5/2009 |

* cited by examiner

HEARING AID AND METHOD FOR PRODUCING A HEARING AID

CROSS-REFERENCE TO RELATED APPLICATION

This is a continuation, under 35 U.S.C. §120, of copending International Application No. PCT/EP2013/063025, filed Jun. 21, 2013, which designated the United States; this application also claims the priority, under 35 U.S.C. §119, of German Patent Application DE 10 2012 222 894.2, filed Dec. 12, 2012; the prior applications are herewith incorporated by reference in their entirety.

BACKGROUND OF THE INVENTION

Field of the Invention

The invention relates to a hearing aid having an antenna device for receiving and/or transmitting electromagnetic waves with a predetermined wavelength lambda, wherein the antenna device has a frame for holding assemblies of the hearing aid. The invention also relates to a method for producing a hearing aid.

Hearing aids are portable hearing apparatuses that are used for the care of the hard of hearing. In order to meet the numerous individual needs, different structures of hearing aids are provided, such as behind-the-ear hearing aids (BTE), hearing aids with an external receiver (RIC: receiver in the canal) and in-the-ear hearing aids (ITE), e.g. including concha hearing aids or channel hearing aids (ITE, CIC). The hearing aids mentioned by way of example are worn on the external ear or in the auditory canal. Furthermore, bone-conduction hearing aids, implantable hearing aids or vibrotactile hearing aids are also commercially available. In this case, the damaged hearing is stimulated either mechanically or electrically.

In principle, the important components of hearing aids are an input transducer, an amplifier and an output transducer. The input transducer is normally an acousto-electrical transducer, e.g. a microphone, and/or an electromagnetic receiver, e.g. an induction coil. The output transducer is generally an electro-acoustic transducer, e.g. a miniature loudspeaker, or an electromechanical transducer, e.g. a bone-conduction receiver. The amplifier is usually integrated in a signal processing device.

In the past, hearing aids have often been regarded as individual systems that reproduce acoustic signals picked up by microphones in appropriately modified and amplified form. Magnetically inductive radio systems have combined those individual systems into an overall system that permits not only binaural coupling of the hearing aids but also wireless connection to external components, such as mobile appliances, multimedia units or programming appliances. However, that connection works only through an intermediate or relay station that converts the 2.4 GHz far-field connection of the external appliances to the magnetic inductive near-field systems by using Bluetooth. In that case, the relay station must always be in proximity to the hearing aid wearer, because the range of the magnetic system is severely limited in the near field.

For a long time, direct connection in the 2.4 GHz far field was limited by the power consumption and size of such systems. However, modern chip systems now have a power consumption that permits use in hearing aids. The sensitivity of the chip systems still makes great demands on the antenna device, however.

Due to the free-space wavelength lambda of more than 10 cm in this band and the electrically small volume of the hearing aid, a standard antenna structure cannot readily be used. Antennas in hearing aids are therefore individual, nonmodular devices that need to be especially adapted to suit the hearing aid.

U.S. Pat. No. 7,593,538 B2 describes an antenna that forms a single-layer or multi-layer loop antenna by using a flexible PCB and is connected to the mother board of the hearing aid.

U.S. Pat. No. 7,450,078 B2 likewise describes a loop antenna that is produced by a single-layer conductor loop in the hearing aid.

European Patent EP1 851 823 B1, corresponding to U.S. Pat. No. 7,646,356, describes an antenna for a hearing aid in which two antenna elements are disposed in spirally shortened fashion on the hearing aid housing.

European Patent EP1 587 343 B1, corresponding to U.S. patent application Publication No. 2005/0244024, discloses a hearing aid with an antenna as a conductive layer in the material of the hearing aid housing.

At the short wavelengths, which are in the region of 10 cm at 2.4 GHz, the influence of the head of the wearer on the antenna characteristics is substantial.

SUMMARY OF THE INVENTION

It is accordingly an object of the invention to provide a hearing aid and a method for producing a hearing aid, which overcome the hereinafore-mentioned disadvantages of the heretofore-known devices and methods of this general type and which improve transmission and/or reception properties when a hearing aid is worn on the head of a wearer.

With the foregoing and other objects in view there is provided, in accordance with the invention, a hearing aid, comprising a hearing aid housing and an antenna device constructed to receive and/or transmit electromagnetic waves having a predetermined wavelength lambda. The antenna device has a frame incorporated in the hearing aid housing for holding assemblies of the hearing aid and the frame has an electrically conductive structure being an integral part of the frame.

The invention thus relates to a hearing aid having an antenna device, wherein the antenna device is constructed to receive and/or transmit electromagnetic waves having a predetermined wavelength lambda. The antenna device has a frame for holding assemblies of the hearing aid, wherein the frame has an electrically conductive structure that is an integral part of the frame. In this context, integral part is intended to be understood to mean that the conductive structure cannot be detached from the frame and is basically part of the external shape of the frame, that is to say it does not protrude a long way therefrom, and the frame is made of a different, nonconductive material, particularly plastic.

Advantageously, the antenna device according to the invention with the frame can be incorporated into a multiplicity of different housings for hearing aids and does not require the antenna device to be adapted to suit the geometry of the housing for every housing in order to attain the same advantageous reception and transmission properties.

With the objects of the invention in view, there is also provided a method for producing a hearing aid, which comprises providing a hearing aid housing and an antenna device constructed to receive and/or transmit electromagnetic waves having a predetermined wavelength lambda. The antenna device has a frame for holding assemblies of the hearing aid, a surface of the frame is patterned or structured, an electrically conductive layer is applied to the surface of the frame, and the frame is incorporated into the hearing aid housing.

The method according to the invention easily permits an antenna device having the desired transmission and reception properties to be produced on a frame in a space-saving fashion, with the complexity of assembly and the costs also being reduced.

The hearing aid having an antenna device according to the invention allows hearing aids having the cited advantageous transmission and reception properties to be provided inexpensively.

In one embodiment, the conductive structure is disposed on the frame in such a way that the antenna device has a reception characteristic that is substantially symmetrical with respect to a first plane through the frame, wherein the first plane is oriented parallel to a second plane, which is a plane of symmetry with respect to the head of the wearer, when the hearing aid is worn in accordance with its intended use.

Since the structure is disposed on the frame in such a way that it has symmetrical reception and transmission characteristics, a hearing aid having an antenna device according to the invention can be constructed in such a way that it can advantageously be worn on either side of the head without the transmission properties being impaired or substantially changed by using the electromagnetic waves.

In another embodiment of the invention, the electrically conductive structure has a first arm and a second arm. The first arm and the second arm are electrically connected to one another at a base point. The first arm extends from the base point in a first direction and the second arm extends from the base point in a second direction. The first direction and the second direction form a substantially right angle. In this context, "form substantially a right angle" is intended to be understood to mean that the angle between the two directions assumes values in the range from 85 to 95° or else in a range from 70 to 110°, for example. In addition, the extension of an arm in a direction covers not only the arm corresponding to a route on a straight line but also the arm following the contours of the surface and in so doing also circumventing obstacles such as recesses in the frame. In this case, the direction of the arm can deviate by a small angle, for example up to 10° or else up to 20°, from the direction at individual points in the extent. In this case, the direction of extent can also be considered to be the direction of a connecting line between end points of the arm. The second arm is at least twice as long as the first arm in this case, but may also be at least three times as long or four times as long as the first arm.

Such a structure advantageously has a shape that can be disposed on a usually elongate shape of a frame.

In a further possible embodiment of the antenna device, the first arm has a coupling point, which is at an interval from the base point, for coupling to a transmission device and/or a reception device in order to couple in or out electric power.

In an added conceivable embodiment of the hearing aid, this coupling point provides an electrical connection for a radio frequency signal to a signal input or signal output of the transmission device and/or reception device of the hearing aid.

The coupling at the first arm advantageously decreases the length that is required for the second arm in order to achieve coupling in or out for an electromagnetic wave that is comparable to the coupling in or out in the case of a monopole.

In an additional conceivable embodiment of the antenna device, the base point has a direct electrical connection for coupling to an electrical ground of a transmission device and/or reception device of a hearing aid.

In a hearing aid according to the invention, this connection provides an electrical connection for a radio frequency signal to the ground of the transmission device and/or reception device of the hearing aid.

Such a short to ground advantageously results in transformation of the impedance of the coupling-in point, so that the characteristic impedance of the antenna device can be transformed to an impedance at the coupling point that corresponds to the impedance of a couplable transmission or reception device and thus advantageously provides a particularly high level of sensitivity or efficiency for the antenna device in connection with the transmission and reception device.

In yet another conceivable embodiment, the antenna device is disposed on the frame in such a way that the second direction is oriented substantially parallel to a second plane, which forms a plane of symmetry for the head of the wearer, when the hearing aid is worn in accordance with the intended use.

The orientation of the second direction in the frame allows a hearing aid with the antenna device to advantageously have comparable reception and transmission properties on both sides when worn on the head.

In yet a further possible embodiment, the electrically conductive structure has a first arm and a second arm that extend away from a coupling point, wherein a transmission device and/or reception device can be coupled to the coupling point for the purpose of coupling in or out electric power. In one embodiment, the first and second arms extend substantially parallel to one another and substantially symmetrically with respect to the first plane. In this connection, substantially parallel to one another is intended to be understood to mean that the first arm and the second arm run at a maximum interval from one another that corresponds to a width of the frame, for example, but they do not move further away from one another as the extent progresses further. Alternatively, it is conceivable for the first arm and the second arm to diverge in a small region, which is smaller than one fifth of the extent is adjacent the coupling point, for example.

Such an antenna device is already intrinsically symmetrical and therefore already advantageously also has symmetrical transmission and/or reception characteristics. In addition, the shape allows the frame to be cut out between the arms in order to afford access to an interior of the frame.

In yet an added possible embodiment of the antenna device, the electrically conductive structure forms a loop.

A loop can send and receive large wavelengths, even in comparison with the dimension of the loop, as a magnetic antenna, so that for a wavelength of 10 cm, for example, a loop of just 1 cm attains good results.

In yet an additional possible embodiment of the method of the invention for producing an antenna device, first of all the surface of the frame is patterned in such a way that where the conductive layer is applied it is applied only in accordance with the patterning. By way of example, the surface of the frame can be treated by using a laser in such a way that a conductor track is deposited only at the treated points in an electroplating bath.

In this way, it is advantageously sufficient to treat only the small surface regions on which a conductive structure needs to be produced, which advantageously reduces the handling time.

In a concomitant embodiment of the method, first of all a conductive layer is applied to the surface of the frame and then the conductive layer is patterned.

In this case, it is possible for the conductive layer to be applied by using adhesive bonding, sputtering or in another way, for example, which require less time than electroplating.

Other features which are considered as characteristic for the invention are set forth in the appended claims.

Although the invention is illustrated and described herein as embodied in a hearing aid and a method for producing a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The properties, features and advantages of this invention that are described above and also the manner in which they are achieved will become clearer and more distinctly comprehensible in connection with the description of the exemplary embodiments that follows, which are explained in more detail in connection with the drawings.

DETAILED DESCRIPTION OF THE INVENTION

Figure 1:
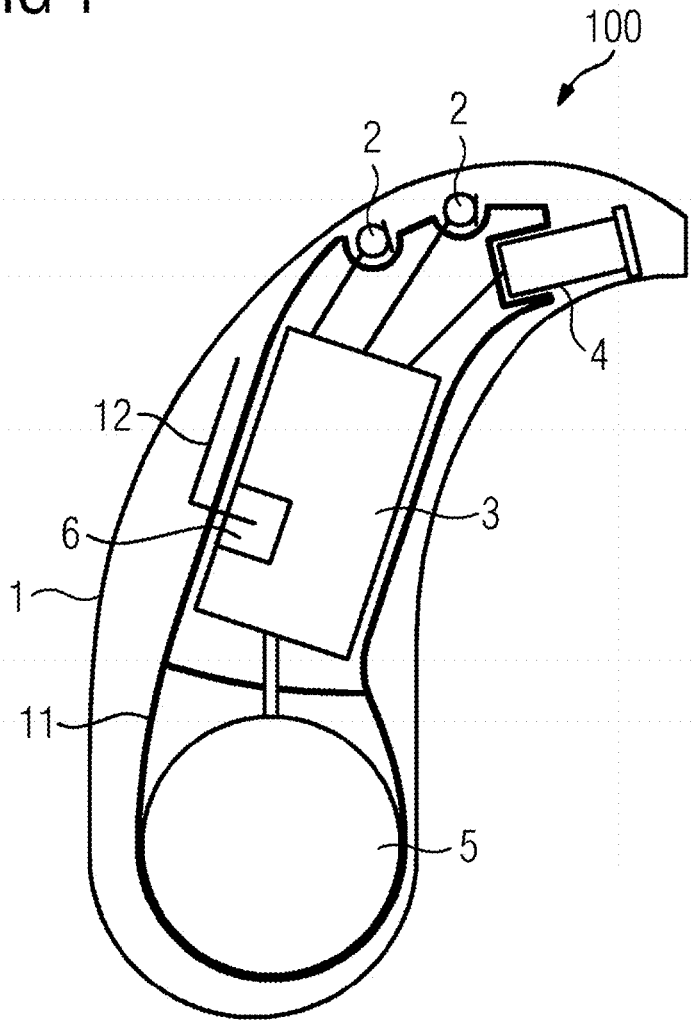
FIG. 1 is a diagrammatic, longitudinal-sectional view of a hearing aid according to the invention.

Referring now to the figures of the drawings in detail and first, particularly, to FIG. 1 thereof, there are seen only the important elements of a hearing aid 100 according to the invention without accurately showing the position, connections or shape thereof.

The hearing aid 100 shown in FIG. 1 is a hearing aid for wearing behind the ear. The invention is also conceivable for in-the-ear hearing aids, however, in which case a different configuration of the components shown is obtained.

A hearing aid housing 1 contains a frame 11 that is part of an antenna device 10. The frame 11 contains one or more microphones 2 for picking up the sound or acoustic signals from the surroundings. The microphones 2 are acousto-electric transducers 2 for converting the sound into first audio signals. A signal processing device 3, which is likewise integrated in the hearing aid housing 1, processes the first audio signals. The output signal from the signal processing device 3 is transmitted to a loudspeaker or receiver 4, which outputs an acoustic signal. The sound may be transmitted to the eardrum of the appliance wearer through a sound tube that is fixed by an otoplasty in the auditory canal. The supply of power to the hearing aid and particularly to the signal processing device 3 is provided by a battery 5 that is likewise integrated in the hearing aid housing 1. The signal processing device 3, the receiver 4 and the battery 5 are likewise disposed in the frame 11, so that the frame with the components disposed therein can easily be removed from the hearing aid housing, for example in order to be able to exchange the hearing aid housing 1.

The signal processing device 3 according to the invention is also constructed for processing electromagnetic waves. The signal processing device 3 has a transmission and/or reception device 6 for producing and detecting electromagnetic waves and/or for decoding. The transmission and/or reception device 6 is electrically connected to an electrically conductive structure 12 of the antenna device 10 in order to transmit and receive electromagnetic waves.

The illustration concerning the shape and configuration in FIG. 1 is only symbolic in this case and is explained in more detail in relation to the subsequent figures.

Figure 2:
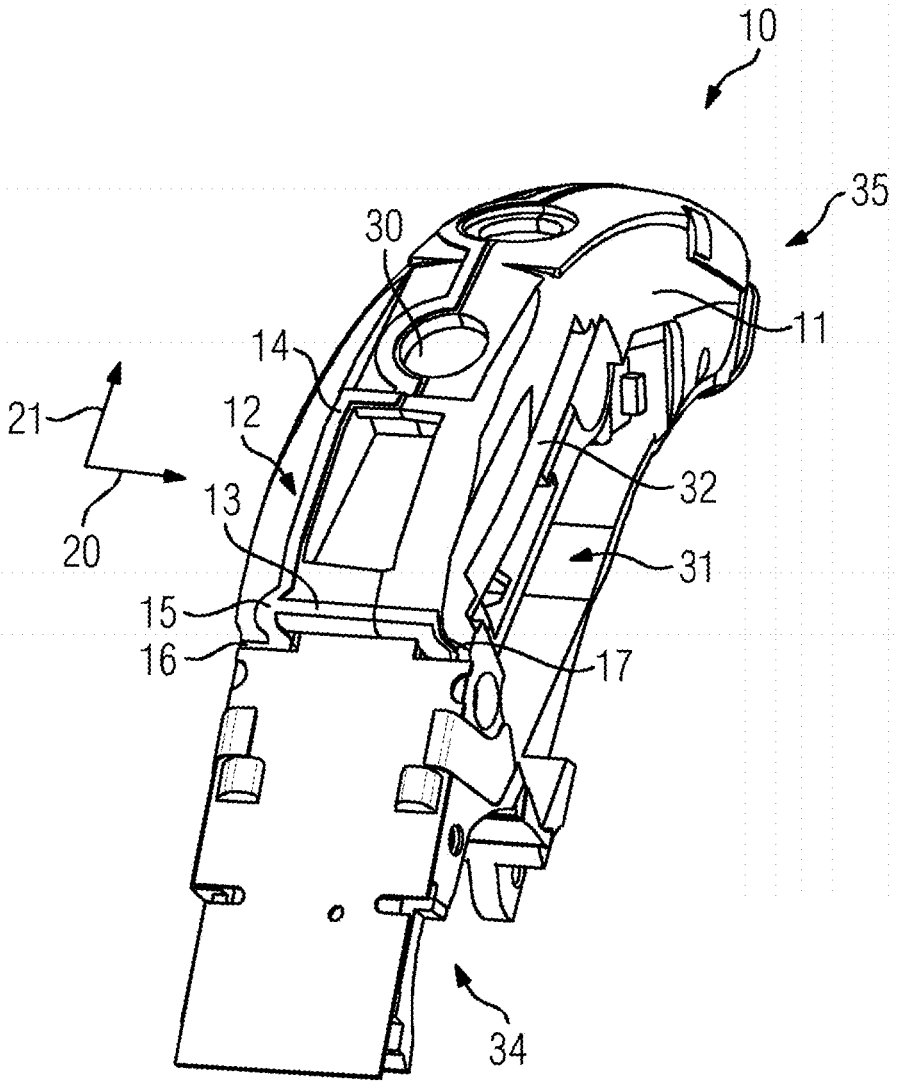
FIG. 2 is a perspective view of an embodiment of an antenna device according to the invention.

FIG. 2 shows an embodiment of an antenna device 10 according to the invention in a perspective view. The antenna device 10 has the frame 11. The frame 11 is manufactured from a nonconductive material, for example from plastic. The frame 11 is provided for the purpose of holding assemblies of the hearing aid 100 and fixing them in a position relative to one another. Thus, an opening 30 is provided on the top, beneath which opening a microphone 2 can be disposed. A recess 31 is provided for the purpose of holding the receiver 4 and a recess 32 is provided for the purpose of holding the signal processing device 3. A battery compartment with the battery 5 can be disposed in a region denoted by reference numeral 34.

The frame 11 is provided for the purpose of being held by a hearing aid housing 1 (not shown in FIG. 2) in order to be worn on the ear of a wearer as a behind-the-ear hearing aid 1. In this case, a point is denoted by reference numeral 35, at which a non-illustrated tube for an otoplasty can be connected. When the hearing aid is worn on the ear in accordance with the application of the device, the point 35 is directed in a second direction 21 forward in the direction of view of the wearer.

Disposed on the upper surface of the frame 11 is an electrically conductive structure 12. In this case, the electrically conductive structure 12 is firmly connected to the surface of the frame 11 as an integral part of the frame 11 and is not disposed at an interval from the surface. As a result, the electrically conductively structure 12 is no longer detachable from the frame and is already provided along with the frame 11. The method for producing the electrically conductive structure 12 on the frame 11 is described below with reference to FIGS. 7 and 8.

The electrically conductive structure 12 is divided into two electrically conductively interconnected arms 13, 14. A first arm 13 extends transversely over the surface of the frame 11 in a first direction 20. A second arm 14 extends substantially in the second direction 21, so that the second arm 14 follows the curvature of the surface of the frame 11 and also circumvents the opening 30 for the microphone 2. Overall, however, an imaginary connecting line between end points of the second arm 14 only deviates from the direction 21 by a few degrees, with deviations of 5, 10 or 20° being conceivable.

The second arm 14 extends substantially along a center line of the frame on the top, which is obtained by virtue of an intersection between the top and a plane of symmetry of the frame, parallel to the direction 21 and at right angles to the direction 20. The deviations result merely from the second arm 14 circumventing openings on the top of the frame.

The first arm 13 and the second arm 14 meet at a base point 15, at which a further electrical connection 16 is disposed that is provided for the purpose of setting up an electrical connection between the base point 15 and an electrical ground of the signal processing device 3. In this case, the electrical connection can be made resistively, capacitively or inductively, so that a high-frequency alternating current can flow from the base point to the ground of the signal processing device.

An angle between the first arm 13 and the second arm 14 or between the directions of extent 20, 21 thereof is substantially 90°, with a discrepancy by a few degrees, such as by 5°, 10° or 15°, being conceivable.

A coupling point 17 is disposed at that end of the first arm 13 that is opposite the base point 15. An electrical conductor is provided at the coupling point 17 for the purpose of coupling the transmission and/or reception device 6, through which the transmission and/or reception device 6 can couple electric radio frequency power into the antenna device for sending or can couple it out for receiving.

In this case, it is of particular advantage that the ground connection at the base point 15 or the short in the antenna device 10 results in transformation of the characteristic impedances between the coupling point 17 and the second arm 14 at this location, so that coupling in or out can take place at the coupling point with lower impedance than would be required by a monopole having a length comparable to the second arm 14. This allows a simpler and more effective layout of the circuit in the transmission and reception device 6.

In this case, the ratio of the characteristic impedances is dependent on the interval or distance between the coupling point 17 and the base point 15 and on the wavelength lambda, while the length of the second arm is substantially dependent on the wavelength lambda. In this case, the second arm 14 is at least twice as long as the first arm 13, but it may also be three times or five times as long.

In an exemplary embodiment of the antenna device 10 of the invention for a frequency of 2.4 GHz, the first arm 13 is 7.7 mm long and the second arm 14 is 21.8 mm.

In addition, the substantially right angle between the first arm 13 and the second arm 14 allows a shorter length of the second arm 14 in comparison with a monopole, which is advantageous given the limited dimensions of the frame.

Figure 3:
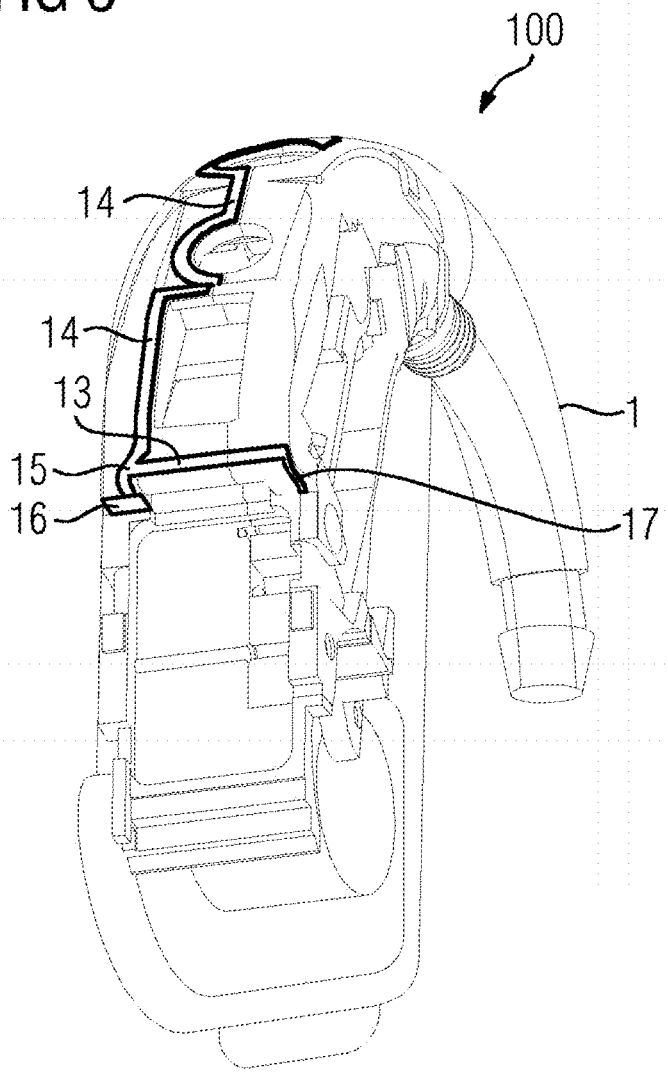
FIG. 3 is a perspective view of a further embodiment of a hearing aid according to the invention.

FIG. 3 shows a hearing aid 100 according to the invention with an antenna device 10 according to the invention. In this case, all elements apart from the electrically conductive structure 12 of the antenna device 10 are shown in semi-transparent form in order to emphasize the latter. In particular, this provides a better view of the position of the antenna device 10 within the housing 1.

Figure 4:
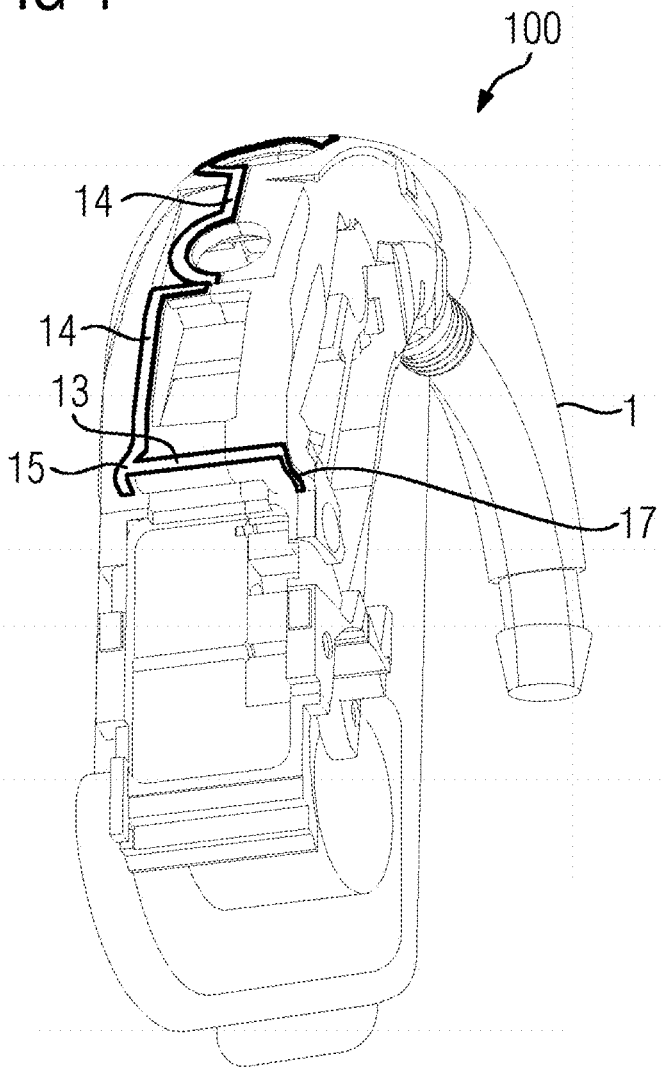
FIG. 4 is a perspective view of yet another embodiment of a hearing aid according to the invention.

FIG. 4 shows a further possible embodiment of a hearing aid 100 with an antenna device 10. The same reference symbols denote the same items.

The subject matter of FIG. 4 differs from the subject matter of FIG. 3 in that there is no provision for an electrical connection 16 to an electrical ground of the signal processing device 3 from the base point 15, at which the first arm 13 and the second arm 14 are electrically connected to one another. Hence, there is no short in the antenna device 10 at the base point 15 and the described transformation of the characteristic impedances between the coupling point 17 and the antenna device 10 does not take place. Therefore, the first arm 13, the second arm 14 and/or the transmission and reception device 6 need to be constructed differently in order to achieve adaptation. By way of example, transformation of the signals and adaptation of the impedances can actually take place in the transmission and reception device 6 by virtue of inductances or capacitances.

Figure 5:
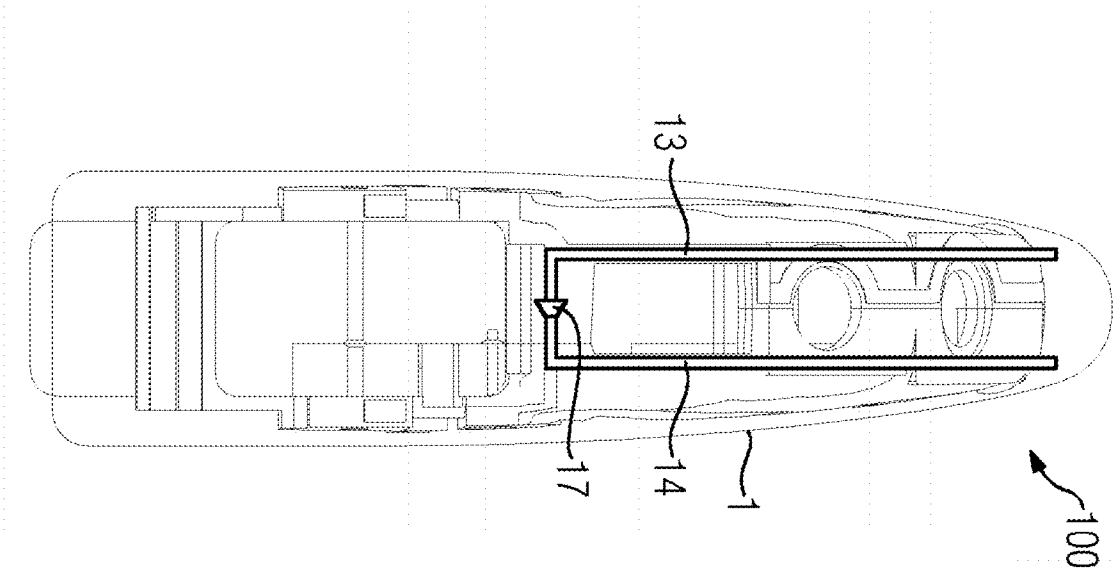
FIG. 5 is a plan view of an embodiment of a hearing aid according to the invention.

FIG. 5 shows a further possible embodiment of a hearing aid 100 with an antenna device 10 in a plan view. In FIG. 5 too, elements that are the same are again denoted by the same reference symbols.

The embodiment of FIG. 5 differs from the subject matter of FIG. 4 in that the first arm 13 and the second arm 14 are of the same length and are disposed on the surface of the frame 11 symmetrically with respect to the plane of symmetry of the frame 11 and the hearing aid 100. The symmetry of the two arms 13, 14 advantageously also results in a high level of symmetry for the resultant antenna characteristics in relation to the plane of symmetry of the hearing aid.

The antenna device 10 of FIG. 5 additionally has no separate base point 15, but rather the first arm 13 and the second arm 14 meet at the coupling point 17. It is possible for a symmetrical waveguide, for example, to couple in RF power from the transmission device 6 or to couple it out to a reception device 6 at this coupling point 17. In this case, the first arm 13 and the second arm 14 are not in resistive contact with one another. Alternatively, inductive coupling by a coil is conceivable, in which case the first arm 13 and the second arm 14 would be electrically connected to one another. Depending on the supply line, different combinations of inductances and capacitances are conceivable for adaptation.

Figure 6:
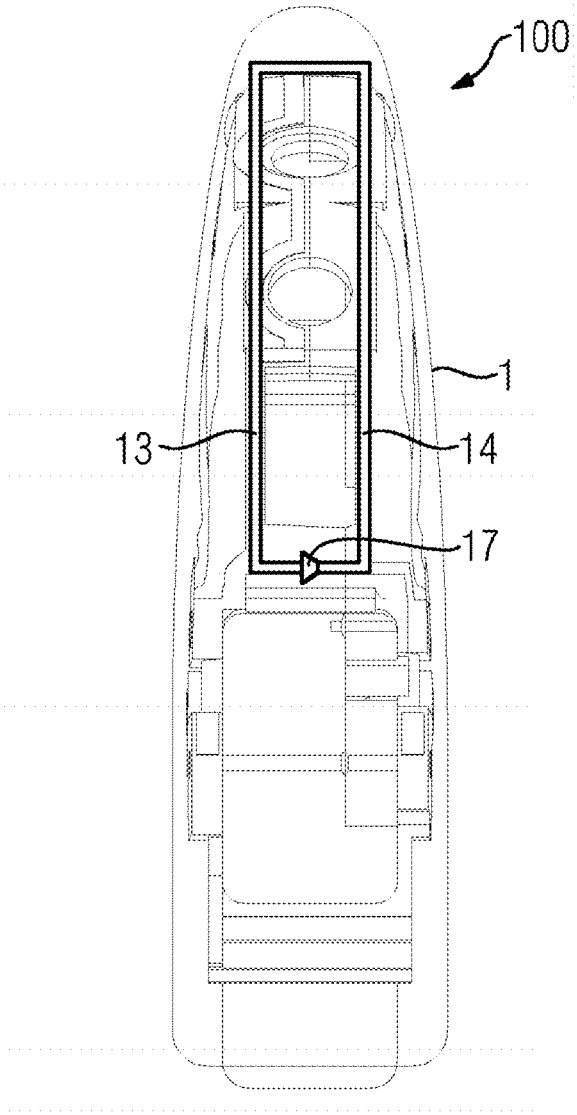
FIG. 6 is a plan view of another embodiment of a hearing aid according to the invention.

FIG. 6 shows another possible embodiment of a hearing aid 100 with an antenna device 10 in a plan view. In FIG. 6 too, elements that are the same are again denoted by the same reference symbols.

The embodiment of FIG. 6 differs from the subject matter depicted in FIG. 4 by virtue of the first arm 13 and the second arm 14 being of the same length and being disposed on the surface of the frame 11 symmetrically with respect to the plane of symmetry of the frame 11 and the hearing aid 100. The two arms meet at the coupling point 17, at which a symmetrical waveguide, for example, couples in RF power from the transmission device 6 or couples it out to a reception device 6. In this case, the first arm 13 and the second arm 14 are not in resistive contact with one another at the coupling point 17. Alternatively, inductive coupling by a coil is conceivable, in which case the first arm 13 and the second arm 14 would be electrically connected to one another at the coupling point.

Furthermore, the antenna device 10 has an electrical connection between the two arms 13, 14 at the end that is at an interval or distance from the coupling point 17, so that the arms 13, 14 form an electrically conductive loop that encloses an area on the surface of the frame. The symmetry of the two arms 13, 14 advantageously also results in a high level of symmetry for the resultant antenna characteristics in relation to the plane of symmetry of the hearing aid.

Figure 7:
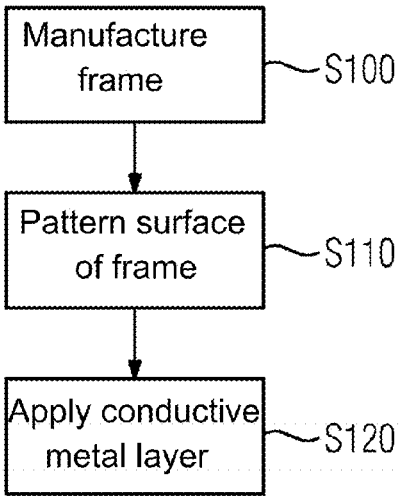
FIG. 7 is a flowchart of an embodiment of the method according to the invention.

FIG. 7 shows a flowchart for a method for producing an antenna device 10 according to the invention. In this case, the antenna device 10 is produced as a molded interconnect device (MID).

In a step S100, a frame 11 is first of all manufactured. The frame 11 is preferably made of a thermoplastic plastic that is put into the desired shape by using injection molding. Alternatively, other methods for production are conceivable, for example by using chemical curing of a plastic in a mold. Milling from a plastic block would also be possible, or printing by using a 3D printer.

In a step S110, the surface of the frame 11 is patterned. In one embodiment, the plastic of the frame is constructed to form germs for later metallization when treated with laser beams at the surface. This can be achieved by virtue of an admixture of metal particles in the plastic, for example. The surface is treated with a laser in accordance with the geometries for the electrically conductive structure 12 that are presented in FIGS. 3 to 6, so that metal particles are exposed at the surface.

Another method for patterning may be milling or stamping of the surface. In this case, it is also conceivable for the patterning of the surface actually to take place in step 100 when the frame 11 is injection molded. By way of example, it is possible for a second injection molding to take place with a second plastic that is suitable for use as a substrate for subsequent metallization, e.g. as a result of a high proportion of metal particles. The second injection molding involves the production of a structure that corresponds to the shape of the electrically conductive structure 12.

In a step S120, a conductive metal layer is then applied. This can take place in an electroplating bath, for example, with a metal layer being deposited around the metal particles only in the regions that the laser beam patterns, and a self-contained electrically conductive structure 12 being formed. The same applies when the second plastic has been applied as a substrate for the metallization.

It would also be conceivable for a metal foil having the desired conductive structure to be permanently connected to the surface, for example by using hot stamping.

Figure 8:
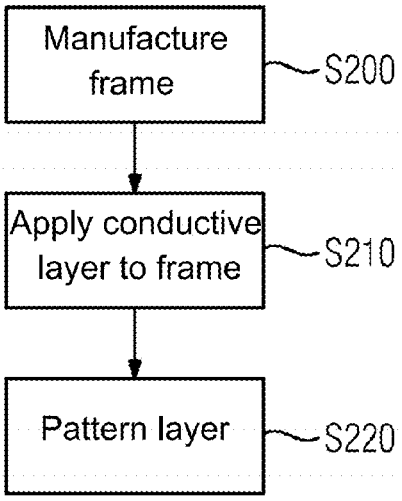
FIG. 8 is a flowchart of another embodiment of the method according to the invention.

FIG. 8 shows a flowchart for an alternative method for producing an antenna device 10 according to the invention. The method of FIG. 8 substantially differs from the method of FIG. 7 in that first of all a conductive layer is applied and only then is it patterned.

In a step S200, a frame 11 is first of all provided. The step S200 corresponds to the step S100 shown in FIG. 7.

In a step S210, a conductive layer is applied to the frame 11 at least in the regions that are later meant to contain the conductive structure 12. By way of example, the conductive layer can be adhesively bonded on as a foil, or applied by using electroplating or by using a spraying, sputtering or vapor deposition method.

In a step S220, this layer is then patterned in such a way that it produces the shape of the desired electrically conductive structure 12. Patterning can be effected by using direct removal of material by laser or mechanically, or else by using chemical methods by applying a mask (using phototechnology or directly) and subsequent etching.

Although the invention has been illustrated and described in more detail by the preferred exemplary embodiment, the invention is not restricted by the disclosed examples and other variations can be derived therefrom by a person skilled in the art without departing from the scope of protection of the invention.

The invention claimed is:

1. A hearing aid, comprising:

a hearing aid housing;

an antenna device constructed to at least one of receive or transmit electromagnetic waves having a predetermined wavelength lambda;

said antenna device having a frame of non-conductive material incorporated in said hearing aid housing, said frame being constructed for holding assemblies of the hearing aid; and said frame having an electrically conductive structure being an integral part of said frame.

2. The hearing aid according to claim 1, wherein said electrically conductive structure is disposed on said frame to provide said antenna device with a reception characteristic being substantially symmetrical with respect to a first plane through said frame, said first plane being oriented parallel to a second plane being a plane of symmetry with respect to the head of a wearer, when the hearing aid is worn in accordance with its intended use.

3. The hearing aid according to claim 1, wherein said electrically conductive structure has a first arm and a second arm being electrically interconnected at a base point, said first arm extends in a first direction and said second arm extends in a second direction from said base point, and said first direction and said second direction form a substantially right angle and said second arm is at least twice as long as said first arm.

4. The hearing aid according to claim 3, which further comprises at least one of a transmitting or receiving device for coupling electric power in or out, said first arm having a coupling point disposed at an interval from said base point and coupled to said at least one of a transmitting or receiving device.

5. The hearing aid according to claim 4, wherein said base point has a direct electrical connection to an electrical ground of said at least one of a transmitting or receiving device.

6. The hearing aid according to claim 3, wherein said antenna device is disposed on said frame with said second direction being oriented substantially parallel to a second plane forming a plane of symmetry for the head of a wearer, when the hearing aid is worn in accordance with its intended use.

7. The hearing aid according to claim 2, wherein said electrically conductive structure has a first arm and a second arm extending away from a coupling point, and at least one of a transmitting or receiving device is coupled to said coupling point for coupling electric power in or out.

8. The hearing aid according to claim 7, wherein said first arm and said second arm extend substantially parallel to one another and substantially symmetrically with respect to the first plane.

9. The hearing aid according to claim 2, wherein said electrically conductive structure forms a loop.

10. A method for producing a hearing aid, the method comprising the following steps:

providing a hearing aid housing;

providing an antenna device constructed to at least one of receive or transmit electromagnetic waves having a predetermined wavelength lambda;

providing the antenna device with a frame of non-conductive material, the frame being constructed for holding assemblies of the hearing aid;

patterning a surface of the frame;

applying an electrically conductive layer to the surface of the frame; and incorporating the frame into the hearing aid housing.

11. The method according to claim 10, which further comprises initially patterning the surface of the frame and then applying the conductive layer only in accordance with the patterning.

12. The method according to claim 10, which further comprises initially applying the conductive layer to the surface of the frame and then patterning the conductive layer.

* * * * *